United States Patent [19]

Egner

[11] 4,256,295

[45] Mar. 17, 1981

[54] ADJUSTABLE CLAMP

[75] Inventor: Elmer A. Egner, 3940 Fontainebleau Dr., Tampa, Fla. 33614

[73] Assignees: Elmer A. Egner; Leonard M. Anton; Carolyn A. Egner, all of Tampa, Fla.

[21] Appl. No.: 136,871

[22] Filed: Apr. 3, 1980

[51] Int. Cl.[3] ..... B25B 1/20

[52] U.S. Cl. ..... 269/45; 269/97; 269/152

[58] Field of Search ..... 269/41–42, 269/88, 95, 97, 98, 152–155, 45, 69, 37, 321 S

[56] References Cited

U.S. PATENT DOCUMENTS

| | | | |
|---|---|---|---|
| 1,160,103 | 11/1915 | Burkhart | 269/97 |
| 1,375,686 | 4/1921 | Felton | 269/152 X |
| 1,410,184 | 3/1922 | Hunter | 269/97 X |
| 1,818,291 | 8/1931 | Abegg | 269/97 X |
| 2,606,583 | 8/1952 | O'Connor | 269/95 X |
| 2,778,393 | 1/1957 | Golasowski | 269/152 X |
| 3,166,307 | 1/1965 | Sego | 269/155 |
| 4,002,328 | 1/1977 | Wolf et al. | 269/97 |
| 4,141,542 | 2/1979 | Wolff | 269/155 X |
| 4,165,869 | 8/1979 | Williams | 269/41 |

FOREIGN PATENT DOCUMENTS

| | | | |
|---|---|---|---|
| 835876 | 4/1952 | Fed. Rep. of Germany | 269/95 |

*Primary Examiner*—Robert C. Watson

*Attorney, Agent, or Firm*—Duckworth, Hobby, Allen & Pettis

[57] ABSTRACT

An adjustable clamp for holding a workpiece wherein the clamp is characterized by a pair of fixed, opposing jaws and a first clamping member movably disposed on one of said jaws. The adjustable clamp further comprises a second clamping member movably attached to a clamp positioning bar formed on the body of the adjustable clamp whereby the second clamping member may be selectively positioned in first and second clamping positions with respect to a normal plane between the jaws. A second embodiment for the adjustable clamp is disclosed comprising a third clamping member operatively mounted on the other jaw in substantially opposing relation to the first clamping member, whereby a workpiece may be centered between the two jaws.

22 Claims, 7 Drawing Figures

ADJUSTABLE CLAMP

BACKGROUND OF THE INVENTION

1. Field of the Invention

The present invention relates to an adjustable clamp for holding a workpiece. In a first embodiment of the invention two clamping members are utilized. The first clamping member is fixed with respect to the clamp body comprising a pair of spaced apart, fixed jaws, and is operatively mounted on one of the two jaws. The second clamping member is movably mounted on a clamp positioning means disposed in interconnecting relation between the jaws, whereby the second clamping member may be selectively positioned in first and second clamping positions with respect to a normal plane extending between the interior faces of the jaws. The angle defined by the first and second clamping positions and the second clamping member is preferably 90°; however, the invention is not limited thereto. In another embodiment of the invention, a third clamping member is provided and is operatively disposed on the other of said jaws in opposing relation to the first clamping member.

2. Description of the Prior Art

Numerous and varied clamping devices are well known in the prior art, particularly in the areas of woodworking and pipe fitting. Perhaps the most common of such prior art devices are vises, miter clamps and "C" clamps. For example, U.S. Pat. No. 2,756,789 to Kraus, et al, discloses adjustable interconnected clamps for attachment to pipes which allows one clamp to be adjusted relative to the other. U.S. Pat. No. 1,319,900 to Reader also teaches a pair of connected clamps, one of which is adjustable relative to the other, as does U.S. Pat. No. 3,937,451 to DiPaola, et al. U.S. Design Pat. No. 135,081 to Breuner shows a pair of attached clamps. Other examples of what may be termed as compound clamps are shown in the following U.S. Letters Patent:

U.S. Pat. No. 1,306,858; Salter

U.S. Pat. No. 4,133,518; Clapper

Thus, it certainly cannot be denied that a great variety of adjustable, compound clamp structures are known in the prior art. However, in order to secure workpieces in a variety of operative positions effectively, it is currently necessary that the craftsman own a great variety of different clamp constructions. Accordingly, it is clear that there is a great need in the art for an adjustable clamp wherein the clamping members may not only be tightened and loosened independently, but also re-oriented with respect to each other so as to allow clamping of various workpieces in a variety of configurations. It is of course desirable that such an adjustable clamp be of sturdy construction so as to fulfill its intended purpose. Perhaps of even greater importance is the desirability of a relatively simple clamp construction so as to facilitate both its use and its manufacture.

SUMMARY OF THE INVENTION

The present invention is directed to an adjustable clamp for holding a workpiece, or a plurality of workpieces, in a predetermined fashion. That is to say, the adjustable clamp of this invention is useful for retaining a single workpiece for fabrication, as well as for retaining two or more workpieces in predetermined relation to each other for subsequent fabrication. By virtue of the construction more fully set forth hereinafter, the adjustable clamp of this invention may also be utilized as a bench vise.

The adjustable clamp comprises a body having a pair of spaced apart, fixed jaws. A support piece is disposed in interconnecting relation between the jaws such that the interior, opposing jaw faces are substantially parallel to each other. A first clamping member is operatively disposed on one of the jaws and is adjustable with respect to the other jaw so as to permit clamping of a workpiece therebetween, or so as to permit attachment of the clamp to a supporting surface such as, for example, a bench. The first clamping member comprises a threaded stem having a first abutment plate mounted on one end thereof and a handle formed at the other end. A threaded aperture is formed through the clamp body jaw, and the first clamping member is mounted thereon by threading the stem through the aperture. In full accord with known construction techniques, turning the handle clockwise will advance the first abutment plate toward the opposing jaw. Turning the handle counterclockwise, then, will move the first abutment plate away from the opposing jaw.

The clamp body further comprises a clamp positioning means disposed in interconnecting relation between the two jaws and a second clamping member is movably mounted on this clamp positioning means. In the preferred embodiment of this invention the clamp positioning means comprises a bar extending in interconnecting relation between the two jaws and substantially normal to the planes defined by the interior jaw faces. A major portion of the longitudinal dimension of the bar comprises a predetermined cross-sectional configuration and, in the preferred embodiment, this cross-section is substantially square. One end of the bar is relieved so as to define a smaller cross-sectional configuration, preferably of a rounded cross-section. A second clamping member is operatively disposed on this clamp positioning means as described above.

The second clamping member comprises a second clamp arm, one end of said arm including an arm aperture of predetermined cross-sectional configuration corresponding to the cross-sectional configuration of the major portion of the bar. Therefore, when the arm aperture is positioned around the relieved portion of the bar, the second clamping member may pivot therearound. Conversely, when the arm aperture is positioned along the major portion of the bar's longitudinal dimension, it is radially fixed, and will not pivot.

The second clamp arm is preferably of an L-shaped configuration, and the arm aperture is formed at the end of the longer leg thereof in substantially perpendicular relation to the longitudinal dimension of the longer leg. The second clamping member further comprises a threaded aperture formed through the end of the shorter leg in substantially parallel relation to the longer leg. A correspondingly threaded second stem is operatively mounted in this threaded aperture and the one end of that second stem passing through the aperture toward the clamp positioning means further comprises a second abutment plate mounted thereon. A handle is formed at the other end of the second stem. By virtue of this construction, the second abutment plate may be moved toward and away from the clamp body.

The preferred embodiment for the adjustable clamp of this invention further comprises a ledge formed on a first end of each jaw, each of said ledges being substantially perpendicular to the corresponding interior jaw face and extending outwardly therefrom. By virtue of this construction, a workpiece may be placed across the ledges, and the second clamping member may be utilized to hold the workpiece thereacross when the second clamping means is disposed in its first clamping position.

When the second clamping means is disposed in its second clamping position, the second stem and its corresponding second abutment plate moves along a plane substantially transverse to the plane defined by the first stem of the first clamping member. Therefore, in this second clamping position the second clamping means may be utilized to secure a second workpiece against a first workpiece held by the first clamping member. It is therefore possible to utilize the adjustable clamp of this invention as a "C" clamp, as a "T" clamp, as a butt clamp, and as a bench vise. It is of course to be appreciated also that pairs of the adjustable clamp of this invention may be utilized together for even greater versatility in securing a plurality of workpieces for further fabrication.

Inasmuch as the adjustable clamp of this invention will be subjected to relatively strong mechanical forces, it is to be understood that the adjustable clamp must be formed from a durable material. Quite satisfactory results have been obtained by casting the clamp body and the second clamp arm from aluminum. Of course, the invention is not to be limited thereto. Furthermore, in the preferred embodiment, both the first and second abutment plates are movably mounted onto their corresponding first and second stems. The movable mounting of the abutment plates allow them to conform to the surface configuration of the workpiece being clamped. It has also been found desirable to provide a reinforcing boss on the exterior of the jaw plate through which the first clamping member is threaded. This reinforcing boss is not critical to the invention, but is considered desirable.

In a second embodiment of the adjustable clamp a third clamping member is provided. The third clamping member is operatively mounted on the other body jaw in substantially opposing relation to the first clamping member. Its construction and attachment is substantially identical to that of the first clamping member. This second embodiment has proved to be particularly desirable in work situations wherein it is deemed necessary to center the workpiece between the body jaws. It has also been determined that in this second embodiment the first and third abutment plates are configured to define corresponding, opposing planar surface having a quadrilateral perimeter so as to increase the effective surface area gripping the workpiece.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
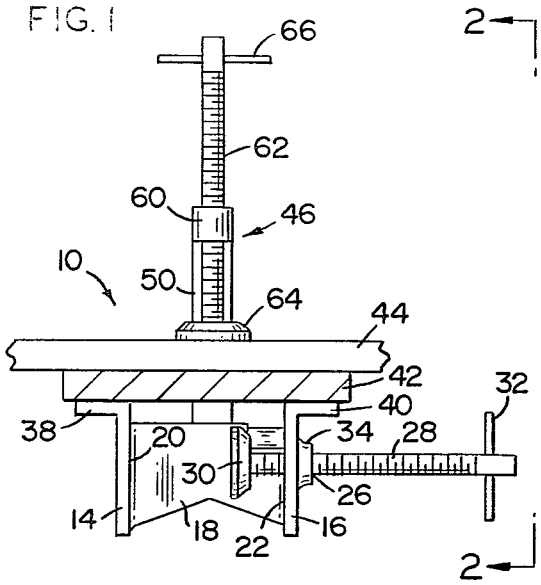
FIG. 1 is an elevational view of the adjustable clamp in its first clamping positioning.
Figure 2:
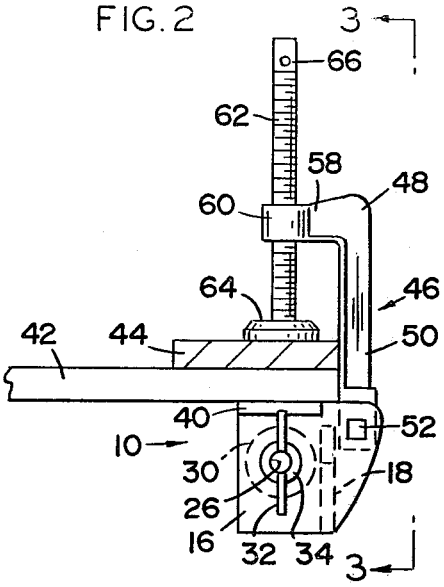
FIG. 2 is a side, elevational view taken along line 2—2 in FIG. 1.
Figure 3:
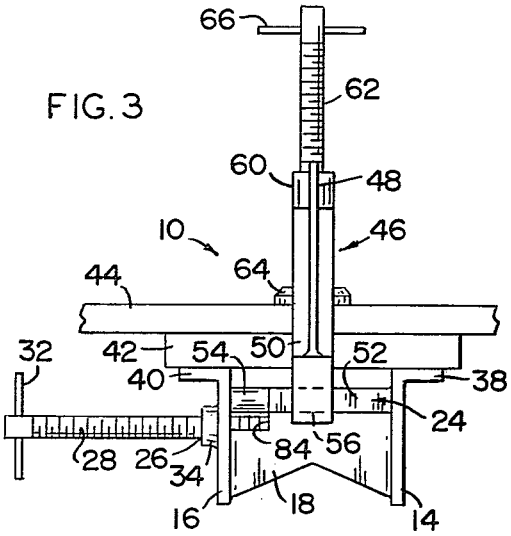
FIG. 3 is a rear, elevational view taken along line 3—3 in FIG. 2.
Figure 4:
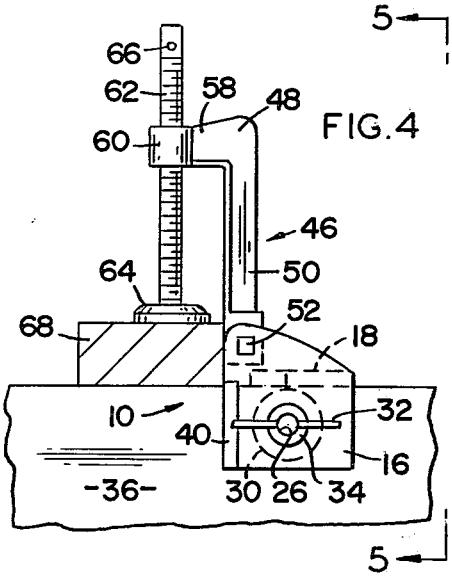
FIG. 4 is a side, elevational view similar to that of FIG. 2, but showing the adjustable clamp in its second clamping position.
Figure 5:
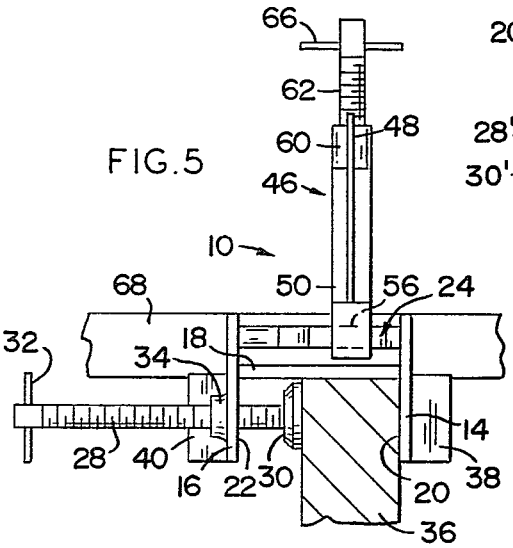
FIG. 5 is a rear, elevational view taken along line 5—5 in FIG. 4.
Figure 7:
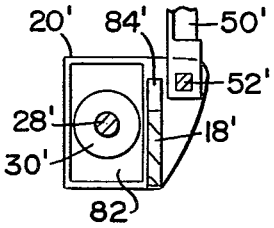
FIG. 7 is a sectional view taken along line 7—7 in FIG. 6.
Figure 6:
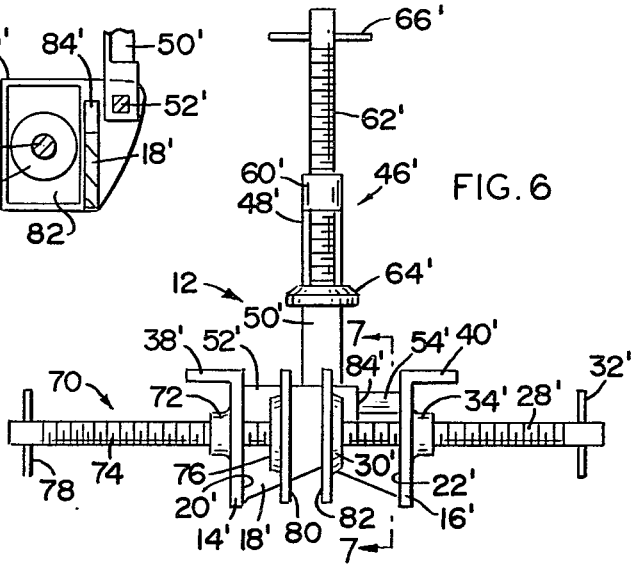
FIG. 6 is an elevational view similar to that of FIG. 1, illustrating a second embodiment of the adjustable clamp.

The adjustable clamp for the present invention is generally indicated as 10 in the views of FIGS. 1–5. The views of FIGS. 6 and 7 depict a second embodiment generally indicated by the reference numeral 12 and fully described below. At this point it should be noted that structural elements of the preferred embodiment 10 which also appear in the second embodiment 12 are indicated by similar reference numerals with the addition of a prime mark to the reference numeral. It should also be noted that the views of FIGS. 1–3 show adjustable clamp 10 in its first clamping position. The views of FIGS. 4 and 5 illustrate adjustable clamp 10 in its second clamping position.

Turning then to the views of FIGS. 1–3, it can be seen that adjustable clamp 10 includes a body comprising a pair of spaced apart, fixed jaws 14 and 16. A support piece 18 is disposed in interconnecting, substantially perpendicular relation between interior face 20 of jaw 14 and opposing interior face 22 of jaw 16. As best seen in the rear view of FIG. 3, clamp 10 further comprises clamp positioning means generally indicated as 24 also disposed in interconnecting relation between jaws 14 and 16.

Referring now to the view of FIG. 2, it can be seen that an aperture 26 is formed through jaw 16. In this preferred embodiment, aperture 26 is threaded so as to operatively receive a first clamping member comprising a threaded first stem 28 therethrough. A first abutment plate 30 is mounted on the end of first stem 28 extending inwardly of jaw 16 and a first handle 32 is formed on the other end of first stem 28. It should also be noted that a reinforcing boss 34 is provided on the outside of jaw 16, the interior of which is congruent with aperture 26. Clearly, then, the first clamping means may be manipulated by first handle 32 so as to advance first abutment plate toward and away from interior face 20 of jaw 14. As best seen in the view of FIG. 5, this permits a workpiece 36 to be held between first abutment plate 30 and interior face 20.

The view of FIG. 1 further shows that jaws 14 and 16 may comprise ledges 38 and 40, respectively, formed on a first end thereof and extending in substantially perpendicular relation to their corresponding interior faces 20 and 22 and outwardly therefrom. As shown in the views of FIGS. 1–3, a first workpiece 42 may be placed across ledges 38 and 40 while a second workpiece 44 may be held in transverse relation thereto by the second clamping member generally indicated as 46. Attention, then, is invited to the construction of second clamping member 46.

As best seen in the view of FIG. 2, second clamping member 46 comprises a second clamp arm 48 which is substantially L-shaped. As best seen in the view of FIG. 3, the free end of longer leg 50 of clamp arm 48 is disposed on clamp positioning means 24. In the preferred embodiment illustrated, clamp positioning means 24 comprises a bar of substantially square cross-sectional configuration along a major portion of its longitudinal dimension 52. The other end of the bar is relieved as indicated at 54 to define a smaller, preferably round, cross-sectional configuration. Longer leg 50 includes an arm aperture 56 of predetermined cross-sectional configuration corresponding to that of portion 52 of clamp positioning means 24 such that clamp arm 48 will slide therealong. By virtue of this construction, in the illustrated preferred embodiment second clamping member 46 may be selectively disposed in the first clamping position of FIG. 1 or the second clamping position of FIG. 4. By virtue of the square configuration shown for major portion 52 of clamp positioning means 24 and the corresponding arm aperture 56, this allows a 90° difference in the effective orientation of second clamping member 46 between its first and second clamping positions.

Shorter leg 58 of second clamp arm 48 includes a rounded portion 60 formed thereon having a threaded aperture formed therethrough in substantially parallel relation to longer leg 50. The second clamping member 46 further comprises a correspondingly threaded second stem 62 operatively mounted in the aperture formed through rounded portion 60. A second abutment plate 64 is mounted on the end of second stem 62 extending through the aperture toward the clamp positioning means 24, and a second handle 66 is provided at the other end of second stem 62. Thus, second handle 66 may be manipulated so as to move second abutment plate 64 toward and away from clamp positioning means 24, and the face of second abutment plate 64 will be substantially perpendicular to longer leg 50 of the second clamp arm 48. Thus, second abutment plate 64 actually engages second workpiece 44 as previously described with regard to the views of FIGS. 1–3. As shown in the views of FIGS. 4 and 5 wherein second clamping member 46 is illustrated in its second clamping position, second abutment plate 64 will engage a third workpiece 68 placed across workpiece 36 as shown.

Having thus set forth a preferred construction for adjustable clamp 10, it is to be remembered that the scope of the invention is not limited to the particular construction shown and described. For example, aperture 26 and the aperture formed through rounded portion 60 need not necessarily be threaded. The relative positions of first stem 28 and second stem 62 could be determined as by a lock nut arrangement. Similarly, while major portion 52 of the clamp positioning means 24 has been described and shown as defining a square cross-section, other configurations might be utilized. Of course, the configuration of corresponding arm aperture 56 would also be modified so as to mate with major portion 52. For example, major portion 52 could be constructed so as to define a polygon of more than four sides, resulting in more than two operative clamping positions for second clamping member 46. It should also be noted that both first abutment plate 30 and second abutment plate 64 are preferably movably mounted on their corresponding first stem 28 and second stem 62 so as to allow their workpiece-engaging faces to engage the workpiece completely. In the case of an adjustable clamp 10 primarily intended for use in clamping tubular objects, it might be desirable to configure the workpiece engaging face of plates 30 and 64 in a non-planar fashion.

Attention is now invited to the views of FIGS. 6 and 7 for their disclosure of a second embodiment of the adjustable clamp, generally identified as 12. As stated above, those structural elements of second embodiment 12 which correspond to first embodiment 10 have been identified by the addition of a prime mark to their reference numeral. This second embodiment 12 basically comprises a third clamping member, generally indicated as 70, movably mounted on jaw 14'. As previously stated with regard to the first clamping member, a threaded aperture (not shown) is formed through jaw 14' and a second reinforcing boss 72 is formed in surrounding relation thereto. A third threaded stem 74 operatively engages the threads of second reinforcing boss 72 and its corresponding aperture, and a third abutment plate 76 is movably disposed on the interior end of third stem 74. A third handle 78 is provided at the other end of third stem 74. By virtue of this construction either, or both of the abutment plates 30' and 76 may be adjusted so as to retain a workpiece therebetween. This second embodiment 12 is particularly useful when it is desired to center a workpiece between jaws 14' and 16'.

Since, in this second embodiment 12, all gripping forces are imparted to the workpiece by the abutment plates 30' and 76, the working face of each abutment plate is preferably enlarged to define a quadrilateral substantially equal in area to their corresponding interior faces 20' and 22' as indicated at 80 and 82, respectively. This construction is further illustrated in the sectional view of FIG. 7. In that sectional view of FIG. 7, it can also be seen that support piece 18' is notched as at 84', said notch corresponding to relieved portion 54' of the clamp positioning means.

A similar notch 84 is also provided in support piece 18 of the first embodiment 10. Notch 84 is provided so that the end of longer leg 50 of second clamp arm 48 is free to rotate between its two operative positions as previously described.

It will thus be seen that the objects set forth above, among those made apparent from the preceding description, are efficiently attained. And, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An adjustable clamp for holding a workpiece, said clamp comprising: a body comprising a pair of spaced apart, permanently fixed jaws and a support piece disposed in interconnecting, substantially perpendicular relation between said jaws, said body further comprising a clamp positioning means fixed to said jaws; a first clamping member movably mounted on one of said jaws; a second clamping member movably mounted on said clamp positioning means, said second clamping member being selectively disposable on said clamp positioning means in at least first and second angular clamping positions with respect to an axis substantially parallel to the first clamping member.

2. An adjustable clamp as in claim 1 wherein each of said jaws comprise an interior face, each of said faces being substantially parallel to the other.

3. An adjustable clamp as in claim 2 wherein each of said jaws further comprise a ledge formed on a first end therefor, each of said ledges being substantially perpendicular to its corresponding interior face and extending outwardly therefrom.

4. An adjustable clamp as in claim 1 wherein said body further comprises an aperture formed through said one jaw, at least a portion of said first clamping member extending through said aperture.

5. An adjustable clamp as in claim 4 wherein said aperture is threaded and wherein said first clamping member comprises a correspondingly threaded first stem operatively mounted in said aperture.

6. An adjustable clamp as in claim 5 further comprising a reinforcing boss formed on said body in surrounding relation to said aperture.

7. An adjustable clamp as in claim 5 wherein said first clamping member further comprises a first abutment plate mounted on one end of said first stem, said one end being defined by the end of said first stem passing through said aperture toward said other jaw, and a first handle formed on the other end of said first stem, whereby the distance between said first abutment plate and said other jaw may be varied.

8. An adjustable clamp as in claim 7 wherein said first abutment plate is movably mounted on said one end of said first stem.

9. An adjustable clamp as in claim 7 wherein said first abutment plate comprises a substantially planar surface in opposed, substantially parallel relation to said other jaw.

10. An adjustable clamp as in claim 9 wherein the perimeter of said planar surface defines a circle.

11. An adjustable clamp as in claim 9 wherein the perimeter of said planar surface defines a quadrilateral.

12. An adjustable clamp as in claim 1 wherein said second clamping member comprises a second clamp arm, one end of said arm being disposed on said clamp positioning means, and a threaded aperture formed through the other end of said arm; said second clamping member further comprising a correspondingly threaded second stem operatively mounted in said aperture.

13. An adjustable clamp as in claim 12 wherein said second clamping member further comprises a second abutment plate mounted on one end of said second stem, said one end being defined by the end of said second stem passing through said aperture toward said clamp positioning means, and a second handle formed on the other end of said second stem, whereby the distance between said second abutment plate and said clamp positioning means may be varied.

14. An adjustable clamp as in claim 13 wherein said second abutment plate is movably mounted on said one end of said first stem.

15. An adjustable clamp as in claim 13 wherein said second abutment plate comprises a substantially planar second surface in substantially perpendicular relation to the longitudinal dimension of said second stem.

16. An adjustable clamp as in claim 15 wherein the perimeter of said planar second surface defines a circle.

17. An adjustable clamp as in claim 12 wherein said clamp positioning means comprises a bar of predetermined cross-sectional configuration along a major portion of its longitudinal dimension, one end of said bar being relieved so as to define a smaller cross-sectional configuration.

18. An adjustable clamp as in claim 17 wherein said one end of said arm comprises an arm aperture of predetermined cross-sectional configuration formed therethrough, whereby said arm may be movably mounted on said bar and whereby the angular relation between said arm and said body may be varied by positioning said arm aperture at said relieved end of said bar.

19. An adjustable clamp as in claim 18 wherein said second stem is substantially parallel to said arm.

20. An adjustable clamp as in claim 19 wherein said support piece comprises a notch formed therein in corresponding, opposed relation to said relieved end of said bar.

21. An adjustable clamp as in claim 19 wherein said arm is substantially L-shaped, said threaded aperture being formed through the shorter leg of said L in substantially parallel relation to the longer leg of said L, and said arm aperture being formed through the longer leg of said L in substantially perpendicular relation to the longitudinal dimension of the longer leg.

22. An adjustable clamp as in claim 1 further comprising a third clamping member movably mounted on the other of said jaws in substantially opposing relation to said first clamping member.

* * * * *